US005681623A

United States Patent [19]

Ferralli

[11] Patent Number: 5,681,623

[45] Date of Patent: Oct. 28, 1997

[54] PROCESS FOR PRODUCING ELECTROSTATIC CLAD CONDUIT INNERDUCT LINER

[75] Inventor: Michael W. Ferralli, Fairview, Pa.

[73] Assignee: Technology Licensing Company, Pittsburgh, Pa.

[21] Appl. No.: 379,876

[22] Filed: Jan. 27, 1995

[51] Int. Cl.[6] ..... B05D 1/04; B05D 1/06; B05D 7/22

[52] U.S. Cl. ..... 427/476; 427/483; 427/486; 427/236; 427/371

[58] Field of Search ..... 427/230, 233, 427/236, 181, 182, 476, 483, 485, 371, 486; 138/145, 146

[56] References Cited

U.S. PATENT DOCUMENTS

| | | | |
|---|---|---|---|
| 2,781,279 | 2/1957 | Miller | 427/480 |
| 3,850,660 | 11/1974 | Inamura et al. | 117/17 |
| 4,468,003 | 8/1984 | Nonclercq et al. | 254/134.3 |
| 5,241,880 | 9/1993 | Mizobata et al. | 74/502.5 |
| 5,472,746 | 12/1995 | Miyajiwa et al. | 427/468 |

FOREIGN PATENT DOCUMENTS

| | | | |
|---|---|---|---|
| 47100947 | 10/1972 | Japan | 427/181 |

*Primary Examiner*—Shrive Beck
*Assistant Examiner*—Fred J. Parker
*Attorney, Agent, or Firm*—Titus & McConomy LLP

[57] ABSTRACT

An electrostatically clad conduit innerduct liner and method for making the innerduct are disclosed, The process includes, heating the innerduct to a temperature less than melting point of the innerduct or a powder to be coated on the inner surface of the innderduct, The powder to be coated is electrically charged and applied to the innerduct by spraying from a nozzle having a different polarity than the innerduct to provide a substantially uniform coating.

16 Claims, 2 Drawing Sheets

PROCESS FOR PRODUCING ELECTROSTATIC CLAD CONDUIT INNERDUCT LINER

FIELD OF INVENTION

The present invention relates to conduit innerduct and specifically to ,an improved conduit or innerduct for cable and method of lining an innerduct or cable conduit with a lubricous, low friction material.

DISCUSSION OF PRIOR ART

It is a well known practice to place telecommunication cable innerduct in conduit to protect the cable. Typically, the conduit is laid in place or an innerduct is placed within the conduit and the cable is pulled therethrough. The innerduct serves as a guide and protector for the fragile telecommunications cable. To reduce the friction encountered during the pulling operation, various methods of lining the interior of the innerduct have been attempted. Heretofore, a significant limitation of reducing the friction involved in pulling a telecommunication cable through an innerduct has been the economy and efficiency of lining the innerduct with a proper low friction, lubricous material.

Innerducts and some conduits are typically polymeric tubes manufactured by extruding a thermoplastic polymer with a line or rope placed therein. This rope is subsequently used to pull the telecommunication cable through the innerduct or conduit. Considering the innerduct or conduit may be manufactured in lengths of 50.00 feet, the process of pulling the telecommunication cable can be quite difficult and potentially damaging to the cable itself if significant friction is encountered between the inner surface of the innerduct and the cable.

One method used to reduce the friction is to texture the inner surface in order to reduce contact points between the cable and inner surface and, thus, the overall friction. However, this method is limited by the intrinsic properties of the innerduct or conduit material, by the material's ability to accept a texture, and by the physical distortion of the texture caused during the cable pulling process.

Another method involves lining the innerduct with a low friction, lubricous liner which is coextruded with the innerduct. This method has the, disadvantage that the coextrusion processes create unnecessarily thick liners. These liners are much thicker than the a one-time cable pulling operation requires. Moreover, co-extrusion is an inefficient way of lining shorter lengths of innerduct or conduit. The process is significantly inefficient in energy use since it involves melting a significant amount of the liner material prior to 'thick cross section' application.

Another method involves the application of lubricating agents to the inner surface of the innerduct or conduits. This solution, however, is ineffective as well as troublesome since, during the pulling process, initial sections of the pulled-through cable tends to remove lubricating material for subsequent sections of the cable. The removal of the lubrication results in an increasing frictional gradient through the innerduct causing a potentially damaging stress gradient in the telecommunications cable. Furthermore, the use of lubricating materials to reduce the friction has a tendency to contaminate the telecommunications cable.

Accordingly it is an object of this invention to overcome the limitations of the prior art methods and provide a method of lining an innerduct with a thin lubricous material which exhibits properties of low friction and ability to be textured in order to aid in the placement and reduce the pull-through force required to install telecommunications cable. It is also an object of the present invention to provide an innerduct having an inner surface with a low coefficient of friction to facilitate pull-through of the cables. It is yet another object of this invention to provide a method of lining a duct with exceptionally thin lining material which will serve to reduce friction for the anticipated single pull-through process while simultaneously providing a material and energy efficient lining method. It is another object of this invention to provide a innerduct, liner which may be compounded with materials known for their low friction properties. It is another object of this invention to provide a innerduct liner which is homogeneous such that surface wear of the liner will not result in exposure of a material displaying increased frictional properties. It is another object of this invention to allow a thin liner material to be deposited with a textured surface in order to reduce surface contact with a telecommunication cable and thus decreased friction during pull-through. It is another object of this invention to produce an innerduct liner by electrostatic deposition of a polymer or other friction reducing material to the inner surface of an innerduct. It is another object of this invention to provide a method of lining an innerduct or conduit which is adaptable to manufacture of short lengths of innerduct or conduit. It is another object of this invention to provide a method of lining an innerduct or conduit which may easily be altered to provide a lining property variability along an innerduct or conduit length.

SUMMARY OF THE INVENTION

Generally, the present invention provides a method for cladding the inner surface of an innerduct which comprises the steps of applying an electrical charge to a powder material which is to be deposited to the inner surface to form the clad inner liner. Preferably the powder is a lubricous, low friction polymer or other material including non-polymeric materials such as graphite, talc and silicon. The powder to be deposited may also consist of a mixture of pigments, stabilizers, lubricating fillers or agents or other additives.

The innerduct or conduit is heated to a temperature near the melting point of the innerduct or conduit or powder. Preferably the temperature is at or near the extrusion temperature of the innerduct or conduit. An electrical charge is applied to the heated innerduct or conduit having a polarity opposite of that applied to the powder. The charged powder is then sprayed onto the inner surface of the innerduct to provide the clad inner surface. With certain types of material to be sprayed, the charge can be reduced to near zero or zero depending upon the temperature of the innerduct.

It is preferred that a heated mandrel be used to fuse or contour the deposited powder on the inner surface. The mandrel is preferably heated to the fusion temperature of the powder. The contour can be grooves or other textures which provide a reduced contact area with the telecommunications cable thereby reducing frictional forces encountered during pull-through of the telecommunications cable. Other advantages of the invention will become apparent from a perusal of the following detailed description of a presently preferred embodiment of the invention taken in connection with the accompanying drawings.

PRESENTLY PREFERRED EMBODIMENT

Figure 1:
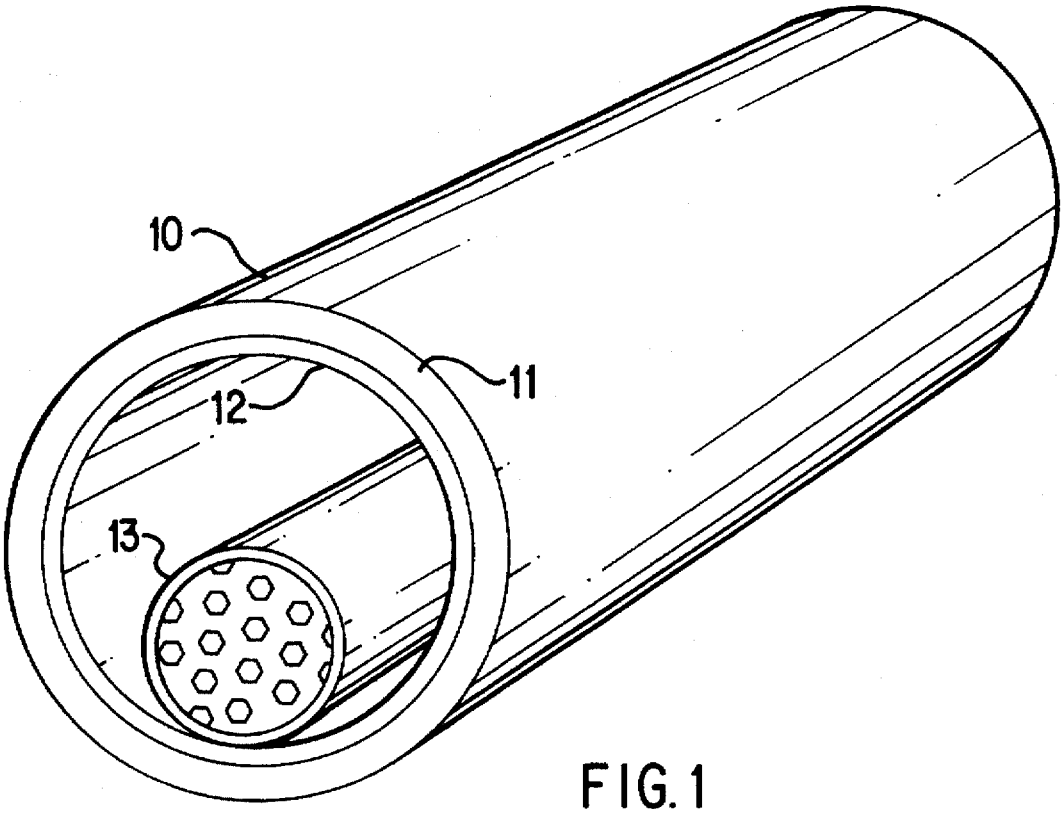
FIG. 1 is a perspective view of an innerduct or conduit formed in accordance with the present invention with a fiber optic telecommunications cable disposed therein.

Referring to FIG. 1, an innerduct or conduit 10 formed in accordance with the present invention is illustrated. Innerduct 10 consists of outer tube 11 which is a polymer, typically polypropylene and formed by an extrusion process. Outer tube 11 has liner 12 which is formed by the electrostatic enhanced deposition of a low friction, lubricous material, which may be polymeric, and which may contain agents and fillers which contribute to the lowering of the frictional properties of the liner when subjected to pull-through of telecommunications cable 13. Suitable material for the inner liner would be polyethylene, polytetrafluouroethylene, polyvinylidene fluoride and like polymeric materials having a low coefficient of surface friction. Suitable friction-reducing fillers include graphite, silicone oils, polytetrafluoroethylene and the like.

Figure 2:
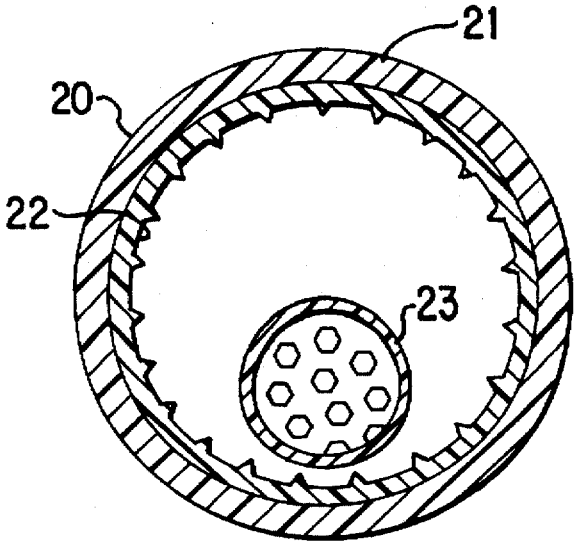
FIG. 2 is a cross sectional view of the innerduct or conduit formed in accordance with the present invention illustrating a grooved texture of the electrostatic enhanced deposited liner.

Referring to FIG. 2, an innerduct 20 is formed in accordance with the present invention is illustrated. The innerduct consists of a outer tube 21 which is a polymer formed by an extrusion process and has a textured liner 21 which is formed by the electrostatic enhanced deposition of a low friction, lubricous material, which may be polymeric, and which may contain agents and fillers which contribute to the lowering of the frictional properties of the liner when subjected to pull-through of telecommunications cable 23. Suitable material for the inner liner would be polyethylene, poyltetrafluoroethylene, polyvinylidene fluoride and the like.

Although FIGS. 1 and 2 illustrate a innerduct whose cross section is circular, it is to be understood that the innerduct 10 and 20 may have any desired cross section shape such a square, rectangular, elliptical, triangular or other required shape for desired end use. Further the textured liner 22 may be formed with undulations having inward projecting ribs whose cross sections which may take on any shape including, but not limited to, square, rectangular, circular and polygonal shapes.

Figure 3:
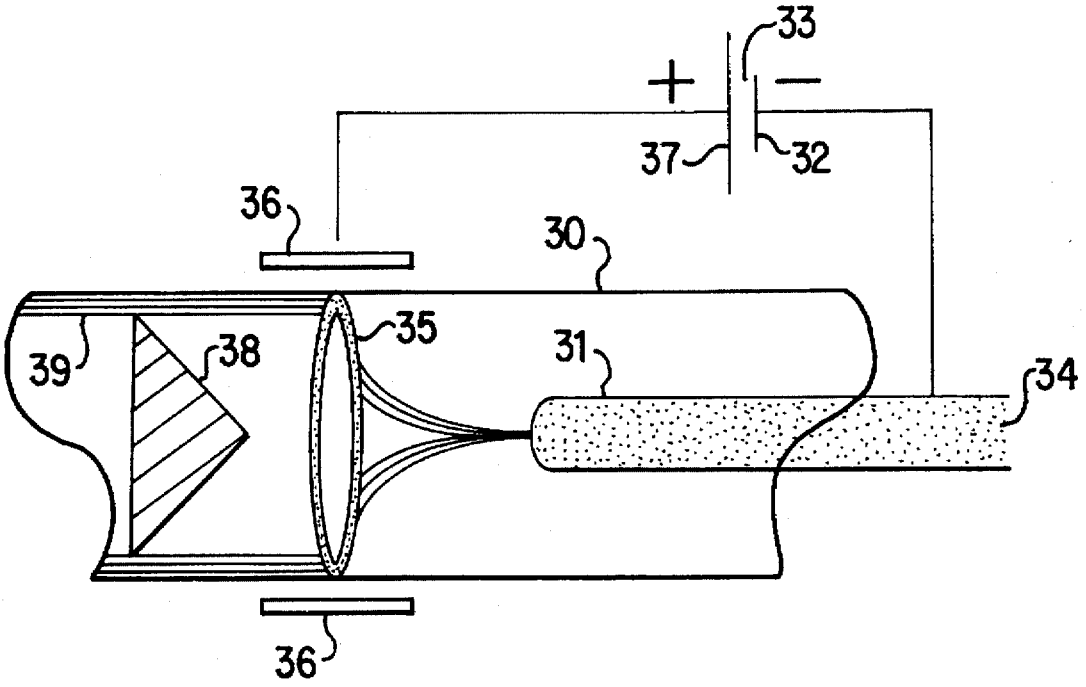
FIG. 3 is a schematic illustration of the preferred embodiment of the electrostatic enhanced deposition process.

Referring to FIG. 3, a schematic illustrating a preferred embodiment of a process of forming the extruded innerduct with the electrostatic enhanced deposition of a liner is shown. An innerduct or conduit 30, at or near its extrusion temperature has contained therein preferably before extrusion, an orificed electrode 31 which is connected to terminal 32 of a source of electric charge 33. Air containing suspended polymeric material 34 in powdered form or liquified droplet is blown through the orifice of electrode 31 which transfers the charge to the polymeric material 34 and disperses it as charged polymeric material 35 in a radially symmetric pattern. Electrode 36, connected to the other terminal 37 of the source of electric charge 33 such that the innerduct inner surface 30 is charged oppositely to the charge on the polymeric material 34 so that the sprayed polymeric material 35 is positioned symmetrically around the interior of innerduct 30. The polymeric material 35 being oppositely charged with respect to the inner duct 30 are attracted to it, deposited and, owing to the elevated temperature of the innerduct 30, fused to the inside surface of innerduct 30. A heated plug 38 acts to further fuse the polymeric material, causing it to form a film 39 and remove the electrical charge from the formed film. The heated plug 38 may optionally have a contoured edge which is in contact with the polymeric film 39, thereby contouring it with a desired texture. For certain types of materials being applied, a relationship may exist between (i) the electrical potential difference across the innerduct inner surface 30 and the polymeric lining material 35 and (ii) the temperature of the innerduct inner surface 30, when the innerduct or conduit is heated to a temperature near the melting point of the innerduct or conduit, or the powder, such that this potential difference can decrease at these increased temperatures.

While the invention has been described in connection with what is presently considered to be the preferred embodiment, it is to be understood the invention is not to be limited to the disclosed embodiments, but on the contrary is intended to cover various modifications and equivalent arrangements included within the spirit of the scope of the appended claims.

What is claimed is:

1. A method of cladding the inner surface of an innerduct or conduit comprised of a thermoplastic polymeric material, said method comprising the steps of:

a. electrically charging a polymeric powder to be deposited on said inner surface;

b. heating the innerduct or conduit to a temperature less than the melting point of said charged polymeric powder;

c. applying an electrical charge to said innerduct or conduit of a polarity opposite from that of said charged polymeric powder; and d. spraying said charged polymeric powder on the inner surface of said innerduct or conduit to provide a substantially uniform polymeric powder coating thereover.

2. A method as set forth in claim 1 including the step of fusing said polymeric powder coating by means of a heated mandrel after step d.

3. A method as set forth in claim 1 wherein said innerduct or conduit is a thermoplastic polymer.

4. A method according to claim 1 wherein said polymeric powder consists of particles of polymer chosen from the group consisting of polyethylene, polytetrafluoroethylene, polyvinylidine fluoride, and mixtures of said polymers.

5. A method according to claim 1 wherein the polymeric powder coating is imparted with a textured surface by means of a heated plug after step d.

6. A method according to claim 1 wherein the electrical charge is non-uniformly applied to a surface of said innerduct or conduit such that said charged polymeric powder is non-uniformly attracted to the inner surface thereof to form a surface clad of non-uniform thickness.

7. A method according to claim 1 wherein the electrical potential difference between the innerduct and said polymeric powder decreases as the temperature of said innerduct or conduit increases.

8. A method of cladding the inner surface of an innerduct or conduit comprised of a thermoplastic polymeric material, said method comprising the steps of:

a. electrically charging droplets of liquified polymeric material to be deposited on said inner surface;

b. heating the innerduct or conduit to a temperature less than the melting point of said liquified polymeric material;

c. applying an electrical charge to said innerduct or conduit of a polarity opposite from that of said liquified polymeric material; and d. spraying the charged liquified polymeric material on the inner surface of said innerduct or conduit to provide a substantially uniform polymeric coating thereover.

9. A method as set forth in claim 8 including the step of fusing the polymeric coating by means of a heated mandrel after step d.

10. A method as set forth in claim 8 wherein said innerduct or conduit is a thermoplastic polymer.

11. A method according to claim 8 wherein the liquified polymeric material is chosen from the polymer group consisting of polyethylene, polytetrafluoroethylene, polyvinylidine fluoride, and mixtures of said polymers.

12. A method as set forth in claim 11 further comprising the step of mixing said liquified polymeric material with materials chosen from a group consisting of graphite and silicone oils.

13. A method according to claim 8 wherein the polymeric coating is imparted with a textured surface by means of a heated plug.

14. A method according to claim 8 wherein the electrical charge is non-uniformly applied to a surface of said innerduct or conduit such that said liquified polymeric material is non-uniformly attracted to the inner surface thereof to form a surface clad of non-uniform thickness.

15. A method according to claim 8 wherein the electrical potential difference between the innerduct and said liquified polymeric material decreases as the temperature of said innerduct or conduit increases.

16. A method of applying a cladding to the inner surface of an innerduct or conduit comprised of a thermoplastic polymeric material, wherein a cladding material is chosen from the group consisting of graphite, talc and silicone, and wherein said method comprises the steps of:

a. electrically charging said cladding material to be deposited on said inner surface:

b. heating said innerduct or conduit to a temperature less than the extrusion temperature of said innerduct or conduit;

c. applying an electrical charge to said innerduct or conduit of a polarity opposite from that of said cladding; and d. spraying said charged cladding on the inner surface of said innerduct or conduit to provide a substantially uniform cladding coating thereover.

* * * * *

UNITED STATES PATENT AND TRADEMARK OFFICE

CERTIFICATE OF CORRECTION

PATENT NO. : 5,681,623

DATED : October 28, 1997

INVENTOR(S) : FERRALLI, Michael W.

It is certified that error appears in the above-identified patent and that said Letters Patent are hereby corrected as shown below:

In Column 2, line 38, the word "silicon" should be changed to "silicone".

Signed and Sealed this

Nineteenth Day of May, 1998

*Attest:*

Bruce Lehman

BRUCE LEHMAN

*Attesting Officer*

*Commissioner of Patents and Trademarks*